US006909345B1

(12) United States Patent
Salmela et al.

(10) Patent No.: US 6,909,345 B1
(45) Date of Patent: Jun. 21, 2005

(54) METHOD FOR CREATING WAVEGUIDES IN MULTILAYER CERAMIC STRUCTURES AND A WAVEGUIDE HAVING A CORE BOUNDED BY AIR CHANNELS

(75) Inventors: Olli Salmela, Helsinki (FI); Esa Kemppinen, Helsinki (FI); Hans Somerma, Veikkola (FI); Pertti Ikäläinen, Huhmari (FI); Markku Koivisto, Espoo (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/030,502

(22) PCT Filed: Jul. 10, 2000

(86) PCT No.: PCT/FI00/00635

§ 371 (c)(1),
(2), (4) Date: May 14, 2002

(87) PCT Pub. No.: WO01/04986

PCT Pub. Date: Jan. 18, 2001

(30) Foreign Application Priority Data

Jul. 9, 1999 (FI) ..... 991585

(51) Int. Cl.[7] ..... H01P 3/18
(52) U.S. Cl. ..... 333/239; 333/34; 29/600
(58) Field of Search ..... 333/239, 248, 333/33, 34, 35; 29/600

(56) References Cited

U.S. PATENT DOCUMENTS 2,232,179 A * 2/1941 King ..... 333/254 X
6,590,477 B1 * 7/2003 Elco ..... 333/239

FOREIGN PATENT DOCUMENTS

| | | |
|---|---|---|
| EP | 0 767 507 A1 | 4/1997 |
| EP | 0 858 123 A3 | 10/1998 |
| EP | 0 883 328 A1 | 12/1998 |
| JP | 10-107518 | 4/1998 |

* cited by examiner

*Primary Examiner*—Benny Lee
(74) *Attorney, Agent, or Firm*—Cohen, Pontani, Lieberman & Pavane

(57) ABSTRACT

The invention relates to a waveguide manufacturing and a waveguide manufactured with the method, which can be integrated into a circuit structure manufactured with the multilayer ceramic technique. The core part (23, 33, 43, 53*a*, 53*b*, 53*c*) of the waveguide is formed by a unit assembled of ceramic layers, which is limited in the yz plane by two impedance discontinuities and in the xz plane by two planar surfaces (24, 25, 34, 35, 54*a*, 54*c*, 55*a*, 55*b*, 55*c*) made of conductive material. The conductive surfaces can be connected to each other by vias made of conductive material (38, 39, 48, 49). The waveguide manufactured with the method according to the invention is a fixed part of the circuit structure as a whole.

31 Claims, 4 Drawing Sheets

METHOD FOR CREATING WAVEGUIDES IN MULTILAYER CERAMIC STRUCTURES AND A WAVEGUIDE HAVING A CORE BOUNDED BY AIR CHANNELS

PRIORITY CLAIM

This is a national stage of PCT application No. PCT/FI00/00635, filed on Jul. 10, 2000. Priority is claimed on that application, and on patent application No. 991585 filed in Finland on Jul. 9, 1999.

FIELD OF THE INVENTION

The invention relates to a method for creating waveguides in circuit board units manufactured with the multilayer ceramic technique, in which method the dimensions and structural directions of the circuit board units can be defined by means of x, y and z axes perpendicular to each other, and the circuit board unit is assembled of separate ceramic layers, the permittivity $\epsilon_r$ of which is higher than the corresponding value of air, and in which layers cavities and holes of the desired shape can be made, and on the surface of which ceramic layer a conductive material can be printed at the desired location by silk screen printing, and the circuit board unit is completed by exposing the unit to a high temperature.

The invention also relates to a waveguide integrated into circuit board units manufactured with multilayer ceramics, wherein the dimensions and structural directions of the circuit board units can be defined by means of x, y and z axes perpendicular to each other, and the circuit board unit has been assembled of separate ceramic layers, the permittivity $\epsilon_r$ of which is higher than the corresponding value of air, and in which layers cavities and holes of the desired shape have been made in the ceramic layers, and on the surface of which ceramic layers a layer of conductive material can be added at the desired location by silk screen printing.

BACKGROUND OF THE INVENTION

Different conductor structures are used in the structures of electronic devices. The higher the frequencies used in the devices, the greater the requirements set for the conductor structures used, so that the attenuation caused by the conductor structures does not become too high or that the conductor structure used does not disturb other parts of the apparatus by radiation. The designer of the device can select from many possible conductor structures. Depending on the application, an air-filled waveguide made of metal, for example, can be used. The basic structure, dimensions, and waveforms that can propagate in the waveguide and the frequency properties of the waveguide are well known (see e.g. chapter 8 Fields and Waves in Communication Electronics, Simon Ramo et al., John Wiley & Sons, inc., USA). FIG. 1 shows, as an example of the dimensioning of a waveguide, a rectangular waveguide made of conductive material, the width of which is a in the direction of the x-axis of the coordinates shown in the figure, the height of which is b in the direction of the y-axis, and which is filled by air, whose permittivity $\epsilon_r$ is of magnitude 1. In the air-filled waveguide shown in FIG. 1, the first (lowest) waveform that can propagate in the direction of the z-axis is the so-called $TE_{10}$(Transverse-electric) waveform. The electric field E of this waveform does not have a component in the direction of the z-axis at all. Instead, the magnetic field H has a component in the direction of propagation, the direction of the z-axis. The so-called cut-off frequency $f_c$ of the waveform $TE_{10}$, which means the lowest frequency that can propagate in the waveguide, is obtained from the equation:

$$f_{cTE_{10}} = \frac{c}{2a}$$

where the letter a means the width a of the waveguide in the direction of the x-axis, and c is the speed of light in a vacuum. Generally, the usable frequency range of the waveguide is 1.2 to 1.9 times the cut-off frequency of the waveform in question. The usable lower limiting frequency is determined by the growth of the attenuation when the cut-off frequency $f_c$ is approached from above. The upper frequency limit again is determined by the fact that with frequencies that are more than twice the cut-off frequency $f_c$ of the desired waveform, other waveforms that are capable of propagating are also created in the waveguide, and this should be avoided.

There are also known waveguide structures, in which the waveguide is formed by a core part made of dielectric material, which is coated with a thin layer of conductive material. However, these waveguides are always made as separate components. The above described waveguide structures provide a small attenuation per unit of length, and they do not emit much interference radiation to the environment. However, the problem with these waveguides is the large physical size compared to the rest of the circuit unit to be manufactured, and the fact that it is difficult to integrate their manufacture into the manufacture of the circuit unit as a whole. These waveguides must be joined to the circuit unit mechanically either by soldering or by some other mechanical joint in a separate step, which increases costs and the risk of failure.

Conductor structures that are better integrated into the structure are also utilized in electronic equipment. These include strip lines, microstrips and coplanar conductors. Their manufacture can be integrated into the manufacture of the circuit unit as a whole, when circuit units are manufactured as ceramic structures. This manufacturing technique is called multilayer ceramics, and it is based either on the HTCC (High Temperature Cofired Ceramics) or LTCC (Low Temperature Cofired Ceramics) technique. The circuit structures implemented with either of these manufacturing techniques consist of multiple layers of ceramic material (green tape), which are 100 $\mu$m thick and placed on top of each other when the circuit structure is assembled. Before the heat treatment, which is performed as the final treatment, the ceramic material is still soft, and thus it is possible to make cavities and vias of the desired shape in the ceramic layers. It is also possible to make various electrically passive elements and the above-mentioned conductors on the desired points with silk screen printing. When the desired circuit unit is structurally complete, the ceramic multilayer structure is fired in a suitable temperature. The temperature used in the LTCC technique is around 850° C. and in the HTCC technique around 1600° C. However, the problem of microstrips, strip lines and coplanar conductors made with these techniques is the high attenuation per unit of length, low power margin and relatively low ElectroMagnetic Compatibility (EMC). These problems limit the use of these conductor structures in the applications where the above-mentioned properties are needed.

SUMMARY OF THE INVENTION

The objective of the invention is to accomplish a waveguide structure implemented with multilayer ceramics, by which the above-mentioned drawbacks of the prior art guide structure can be reduced.

The method according to the invention is characterized in that for creating a waveguide in the direction of the z-axis:

at least two impedance change points in the direction of the yz plane of the structure are formed in the structure to limit the length a of the core of the waveguide in the direction of the x-axis, and that in the xz plane, the core of the waveguide is limited with a first and a second layer of conductive material, which is silk screen printed on top of the ceramic layers that form the core of the waveguide, and which conductive planes are used to limit the length b of the core of the waveguide in the direction of the y-axis.

The waveguide according to the invention is characterized in that it comprises:

the core part of the waveguide of the structure of the circuit unit in the direction of the z-axis, at least two points of impedance discontinuity in the yz-plane, by which the length a of the core part of the waveguide has been limited in the direction of the x-axis, and a first and a second layer of conductive material in the xz plane, by which layers the dimension b of the core part of the waveguide has been limited in the direction of the y-axis.

The basic idea of the invention is the following: A waveguide fully integrated into the structure is manufactured with the multilayer ceramic technique. The core part of the waveguide is made of dielectric material with a suitable permittivity $\epsilon_r$, which is separated from the rest of the ceramic structure in one plane by two layers of conductive material forming parallel planes, and in another plane, which is perpendicular to the previous planes, by two cavities filled with air and/or joining holes filled with conductive material.

The invention has the advantage that the waveguide can be manufactured simultaneously with other components manufactured with the multilayer ceramic technique.

In addition, the invention has the advantage that the feeding arrangement of the waveguide can be implemented with the same multilayer ceramic technique.

The invention also has the advantage that the manufacturing costs of a waveguide manufactured with the method are lower than those of a waveguide made of separate components and joined to the structure in a separate step.

Furthermore, the invention has the advantage that it has a good EMC protection as compared to a strip line, microstrip or coplanar conductor.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the following, the invention will be described in more detail. Reference will be made to the accompanying drawings, in which.

DETAILED DESCRIPTION OF THE PREFERRED EMBODIMENTS

Figure 1:
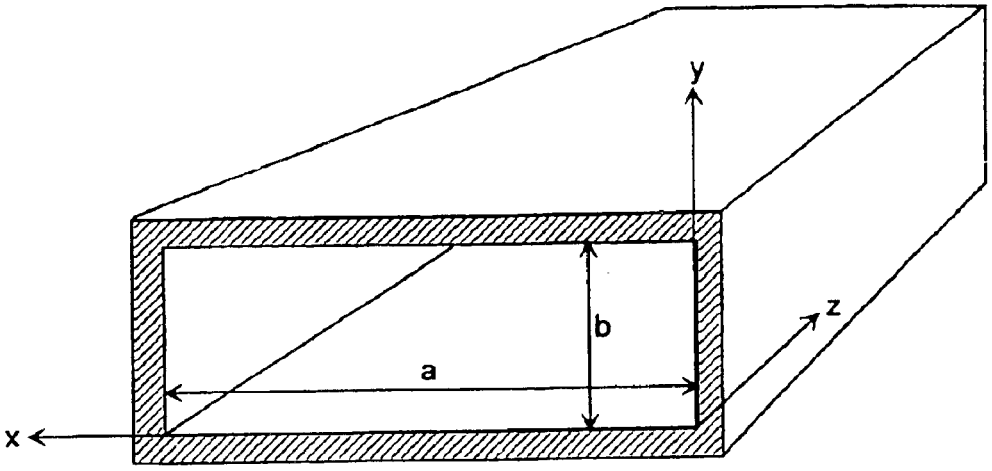
Fig. 1 PRIOR ART
FIG. 1 shows a prior art, air-filled waveguide made of conductive material.

FIG. 1 was presented in connection with the description of the prior art. In connection with the description of FIGS. 2 to 6, reference is made to the directions of the axes x, y and z shown in FIG. 1. The directions of the axes are the same as those shown in the example of FIG. 1, although the axes are not drawn in all the figures. The symbol $\epsilon_r$ in this and the following figures refers to the particular value of permittivity which the materials marked "$\epsilon_r$" have, i.e. all the ceramic material is labeled "$\epsilon_r$" to indicate they all have the same permittivity.

Figure 2:
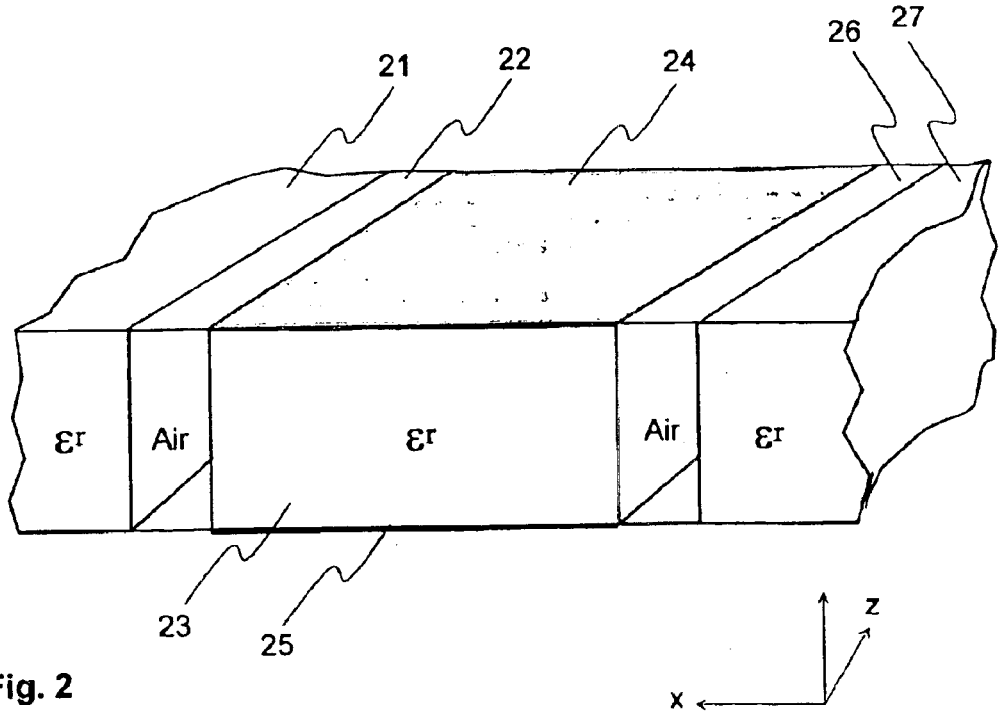
FIG. 2 shows an exemplary embodiment implemented with the multilayer ceramic technique, in which the side walls of the waveguide are formed of cavities filled with air.

FIG. 2 shows an example of a waveguide according to the first embodiment of the invention, implemented with the multilayer ceramic technique. The structure shown in FIG. 2 is part of a larger circuit structure implemented with the multilayer ceramic technique, which is not shown in its entirety in the drawing. The waveguide structure is surrounded on both sides by the structures 21 and 27 shown in the drawing, which consist of several green tapes. The permittivity $\epsilon_r$ of the ceramic material used in them is clearly higher than the permittivity of air, which is of the magnitude 1, as is well known. Other parts of the structure, which are both above and below the waveguide structure shown in the drawing, viewed in the direction of the y-axis, consist mainly of the same ceramic material. The core part 23 of the waveguide consists of the same ceramic material as the rest of the circuit structure. The width of the waveguide in the direction of the x-axis is limited by air-filled cavities 22 and 26 essentially in the direction of the yz plane. The interface of the air-filled cavity 22 or 26 forms a discontinuity of the characteristic impedance against the core part 23 in view of the electromagnetic wave front. This discontinuity of the characteristic impedance mainly reflects the wave front, which is capable of propagating in the core part 23 of the waveguide, back to the core part 23, while the wave front propagates in the direction of the z-axis. The waveguide is limited in the xz-plane by a first surface 24 and a second surface 25, which are made of some conductive material and which form essentially parallel planes. These planar surfaces 24 and 25 can be made either such that they completely cover the core part 23 or they are partly gridded. These planar, conductive surfaces 24 and 25 can be made, for example, of conductive pastelike material, by metallizing the surfaces of the core part 23 in these planes or also by covering the core part 23 by separate, thin, conductive filmy material.

In the waveguide according to the first embodiment of the invention, the lowest possible propagating waveform is the TEM (Transverse-electromagnetic) waveform, the electric or magnetic field of which does not have a component in the direction of the z-axis of the drawing. The cut-off frequency of this waveform is 0 Hz, as is known, which means that direct current can flow in the waveguide. A waveguide according to the first embodiment of the invention can also transmit other higher, possibly desired $TE_{mn}$ or $TM_{mn}$ (Transverse-magnetic) waveforms, the corresponding cut-off frequencies of which can be calculated according to the dimensioning rules of an ordinary waveguide, which dimensioning rules have been presented in connection with the description of FIG. 4.

Figure 3:
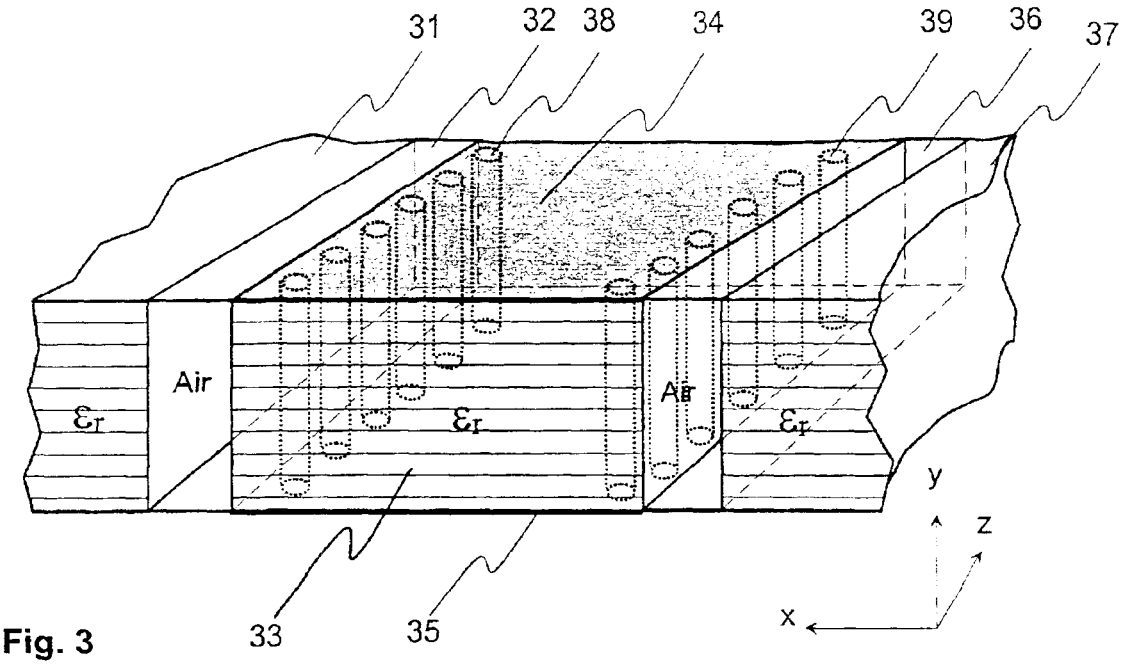
FIG. 3 shows another exemplary embodiment implemented with the multilayer ceramic technique, in which the side walls of the waveguide are formed of air-filled cavities and vias in the vicinity thereof, filled with conductive material.

FIG. 3 shows an example of a waveguide according to the second embodiment of the invention. The structure shown in FIG. 3 is part of a larger structure implemented with the multilayer ceramic technique, which is not shown in its entirety in the drawing. The waveguide structure is surrounded on both sides by the structures 31 and 37 shown in the drawing, which consist of several green tapes. The permittivity $\epsilon_r$ of the ceramic material used in them is clearly higher than the permittivity of air, which is of the magnitude 1. Other parts of the structure, which are both above and below the waveguide structure shown in the drawing, viewed in the direction of the y-axis of the drawing, also consist mainly of the same ceramic material. The core part 33 of the waveguide consists of the same ceramic material as the rest of the circuit structure. The width of the waveguide in the direction of the x-axis is limited by two essentially parallel impedance discontinuities, which are formed of via posts 38 and 39 in the direction of the y-axis of the drawing together with the air-filled cavities 32 and 36. The air-filled cavities 32 and 36 have a similar construction as was presented in connection with the description of the cavities shown in FIG. 2. The via posts 38, 39 are filled with conductive, pastelike material in connection with the manufacture of the circuit structure. When the LTCC technique is used, either AgPd paste or Ag paste can be used advantageously. If the waveguide structure according to the invention is entirely surrounded from all sides by other ceramic layers, the cheaper Ag paste can be used. If part of the created waveguide structure remains exposed to the external atmosphere, the more expensive AgPd paste must be used. The via posts 38, 39 combine the essentially parallel first plane 34 and second plane 35, which are formed of conductive material and which limit the core part 33 in the xz plane.

In the embodiment shown in FIG. 3, one via post 38 and 39 for each side of the core part are shown in the drawing as viewed in the direction of the x-axis. The waveguide structure according to the invention can also be implemented by adding several similar via posts to the core part 33. It is also possible to add more similar via posts to the parts 31 and 37 of the circuit structure behind the air cavities 32 and 36, whereby the EMC properties of the waveguide are further improved.

Figure 4:
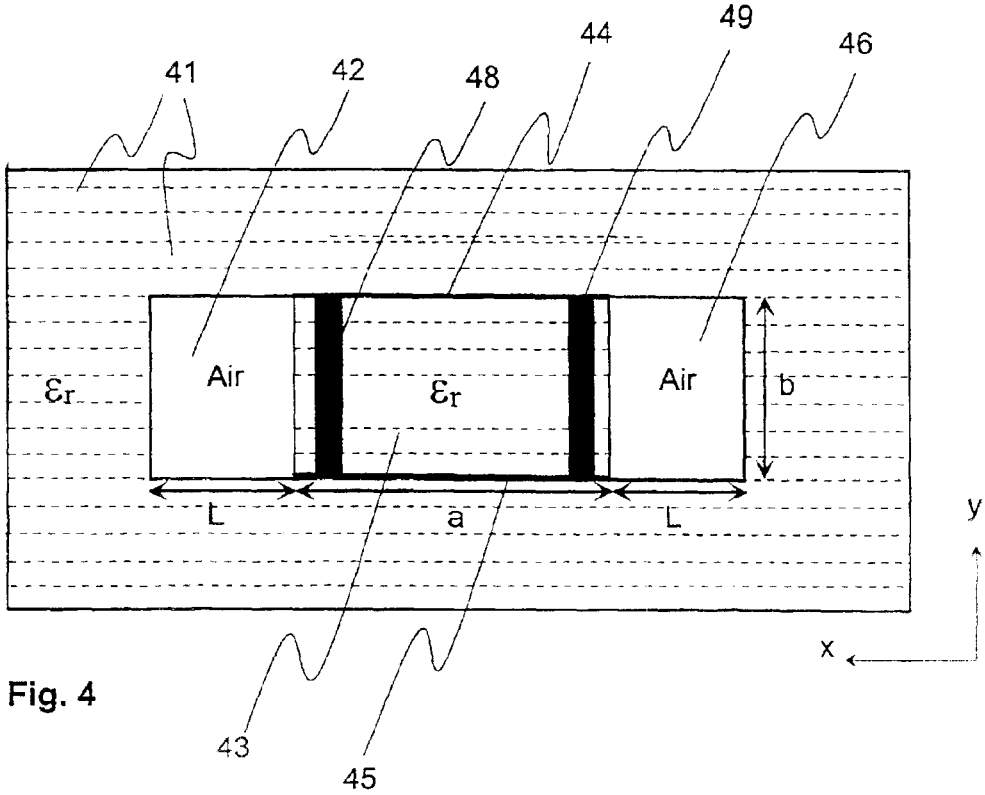
FIG. 4 shows an example of a waveguide according to the second embodiment of the invention implemented with the multilayer ceramic technique as a section in the x-y plane.

FIG. 4 shows an example of a structure according to the second embodiment of the invention as a section in the xy plane. The ceramic circuit structure is assembled by layers of ceramic plates/strips 41. The waveguide is separated from the rest of the structure in the direction of the x-axis by air-filled cavities 42 and 46 in the direction of the yz plane (not shown in FIG. 4), the width of which cavities is the measure L shown in the drawing and the height is the measure b shown in the drawing, and via posts 48 and 49 filled with conductive material. The core part 43 of the waveguide is formed by ceramic material, the permittivity $\epsilon_r$ of which is high compared to air. The width of the core part of the waveguide in the direction of the x-axis in denoted by the letter a in the drawing. The width L of the air-filled cavities 42 and 46 in the x-plane is selected such that its magnitude corresponds to a fourth of the wavelength of the cut-off frequency $f_c$. Then the waveguide structure emits as little interference radiation as possible to its environment. In the xz plane (not shown in FIG. 4), which is perpendicular to the surface shown in FIG. 4, the waveguide is limited by a first plane 44 and a second plane 45, which are essentially parallel and made of conductive material. The first plane 44 and the second plane 45 are connected to each other by vias 48 and 49, which are filled with conductive material. The waveforms $TE_{mn}$ and $TM_{mn}$ can propagate in a waveguide according to the embodiment shown in the drawing. The cut-off frequencies $f_{cmn}$ of these waveforms are obtained from the known formula:

$$f_{cm,n} = \frac{1}{2\sqrt{\mu\varepsilon}}\sqrt{\left(\frac{m}{a}\right)^2 + \left(\frac{n}{b}\right)^2}$$

In the formula, the indexes m and n refer to the number of maximums in the direction of the x and y axes of the transverse field distribution of the $TE_{mn}$ or $TM_{mn}$ waveform, measure a denotes the width of the waveguide in the direction of the x-axis, and measure b denotes the height of the waveguide in the direction of the y-axis. The terms $\mu$ and $\epsilon$ in the formula are the permeability and permittivity values of the ceramic material of the core part 43 of the waveguide.

Figure 5A:
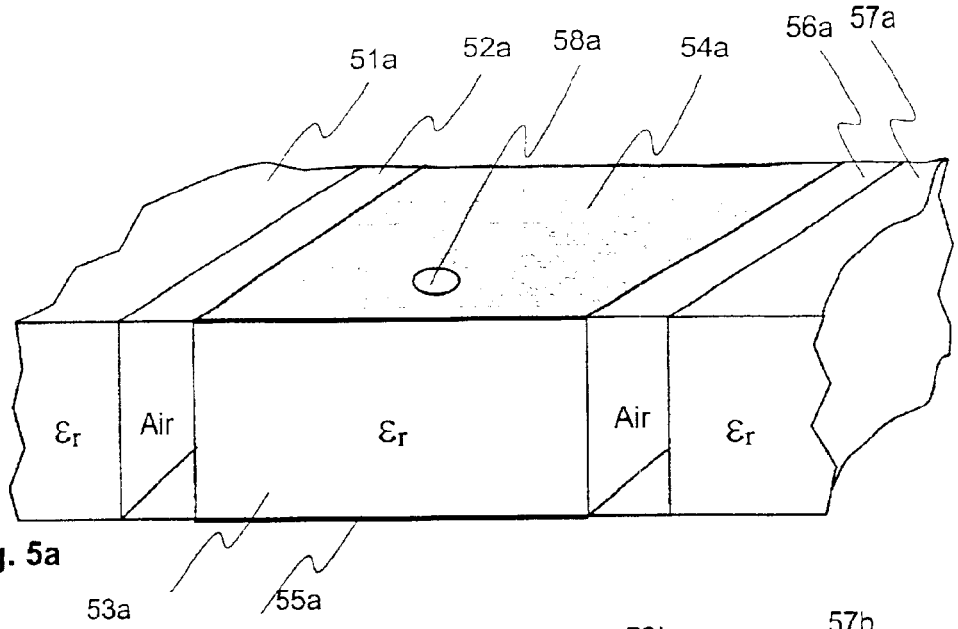
FIG. 5*a* shows an example of one way according to the invention to excite a waveform capable of propagating in the waveguide according to the first embodiment of the invention.
Figure 5B:
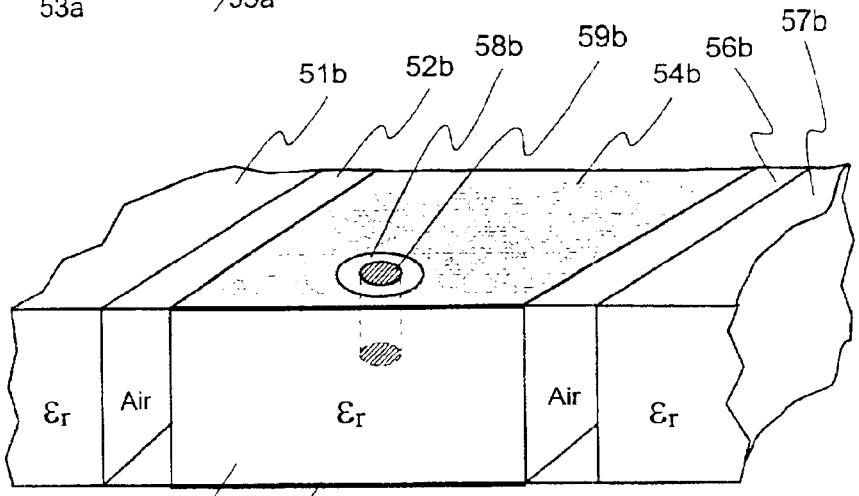
FIG. 5*b* shows an example of another way according to the invention to excite a waveform capable of propagating in the waveguide according to the first embodiment of the invention.
Figure 5C:
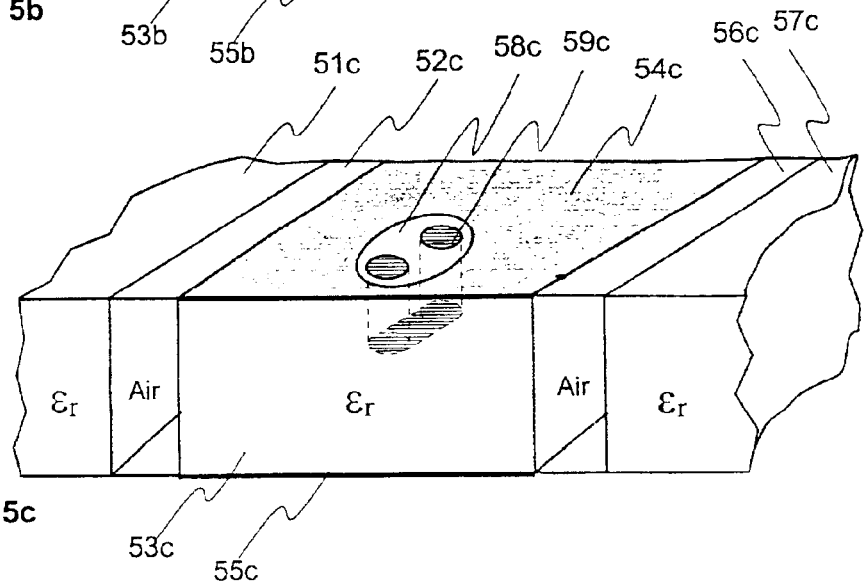
FIG. 5*c* shows an example of a third way according to the invention to excite a waveform capable of propagating in the waveguide according to the first embodiment of the invention.

FIGS. 5*a*, 5*b* and 5*c* show three different examples of how the desired waveform can be excited in waveguides according to the invention. The waveguide used in the examples of the figures is a waveguide according to the first embodiment, but the solutions function in accordance with the same principle in waveguide structures according to the second embodiment of the invention as well.

In the example of FIG. 5*a*, the core 53*a* of the waveguide is separated from the rest of the circuit structure, which is represented by parts 51*a* and 57*a* of the structure in the drawing, by air-filled cavities 52*a* and 56*a* and a first plane 54*a* and a second plane 55*a*, which are essentially parallel and made of conductive material. In order to excite the desired waveform, a hole 58*a* has been made at the desired point in the first plane 54*a* of the waveguide. When a radiating element, which is not shown in the drawing, is placed in the vicinity of the hole 58*a*, the result is that part of the field radiated by the element is transferred through the hole 58*a* to the waveguide according to the invention. The radiating element can be any circuit element capable of radiating, or possibly another waveguide according to the invention, in the wall of which a hole of corresponding shape and capable of radiating has been made. By selecting the radiating frequency correctly, an electromagnetic waveform of the desired kind and capable of propagating can be excited in the waveguide.

FIG. 5*b* shows another possible way of exciting a waveform capable of propagating in a waveguide according to the invention. In the example of FIG. 5*b*, the core 53*b* of the waveguide is separated from the rest of the circuit structure, which is represented in the drawing by parts 51*b* and 57*b*, by air-filled cavities 52*b* and 56*b* and a first plane 54*b* and a second plane 55*b*, which are essentially parallel and made of conductive material. In order to excite the desired waveform, there is a hole 58*b* made at the desired point of the conductive first plane 54*b*, and the hole is fitted with a cylindrical probe 59*b* leading to the core part 53*b* of the waveguide.

The probe is preferably made of the same conductive material as the planar first surface 54*b* and second surface 55*b* of the waveguide. The probe 59*b* is connected to the desired signal inputting conductor in the circuit structures above the planar first surface 54*b*. The signal conductor can be a strip line or a microstrip, for example. The conductor and other circuit structures above are not shown in FIG. 5*b*.

FIG. 5*c* shows a third possible way of exciting a waveform capable of propagating in a waveguide according to the invention. In the example of FIG. 5*c*, the core 53*c* of the waveguide is separated from the rest of the unit, which is represented in the drawing by parts 51*c* and 57*c*, by air-filled cavities 52*c* and 56*c* and a first plane 54*c* and a second plane 55*c*, which are essentially parallel and made of conductive material. In order to excite the desired waveform in the waveguide, there is a hole 58*c* made at the desired point of the first plane 54*c* made of conductive material, and the hole is fitted with a coupling loop 59*c* leading to the core part 53*c* of the waveguide. The coupling loop 59*c* is connected to the desired signal inputting conductor in the circuit structures above the planar first surface 54*c*. The signal conductor can be, for example, a stripline, microstrip or a coplanar conductor. The signal inputting conductor and other circuit structures above are not shown in FIG. 5*c*. The coupling loop 59*c* is manufactured of conductive material in connection with the manufacture of the rest of the circuit structure implemented with the multilayer ceramic technique.

Figure 6A:
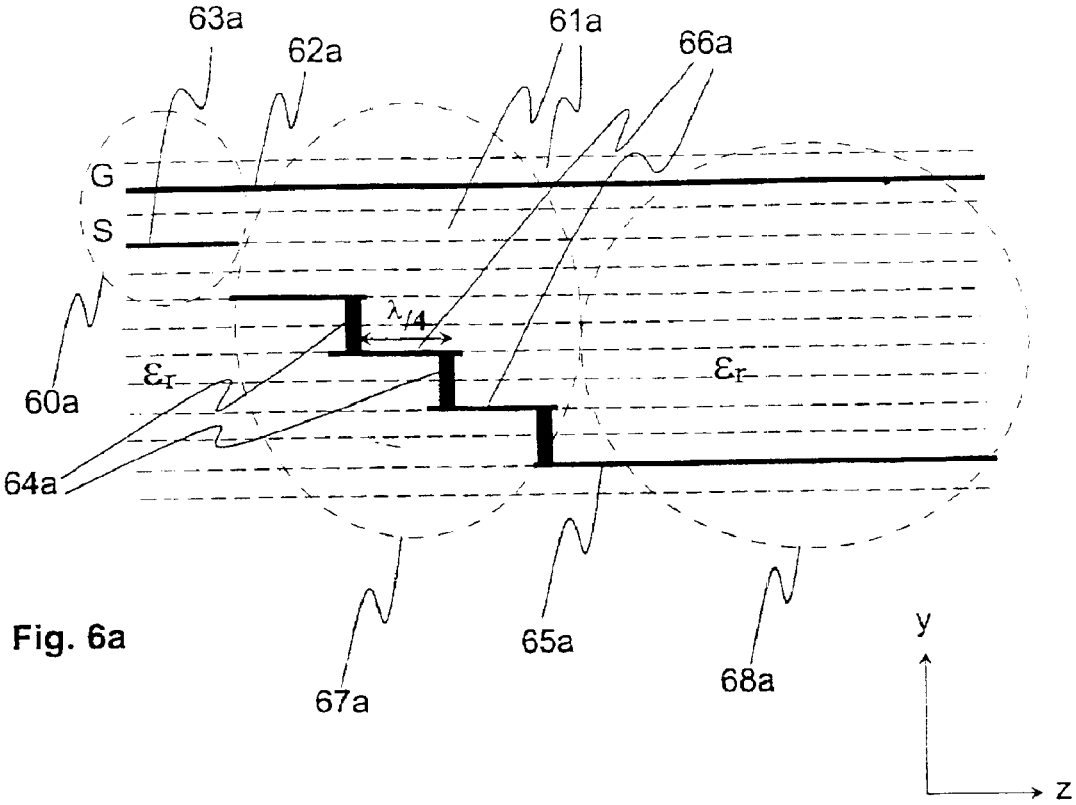
FIG. 6*a* shows an yz-plane presentation of one way of joining a waveguide according to an embodiment of the invention to a microstrip conductor.

FIG. 6*a* shows, by way of example, how the microstrip and the waveguide according to the invention can be joined together. The figure shows a section in the yz plane of the point where the conductors are connected. The circuit structure has been implemented by joining together several layers of ceramic plates 61*a*. The portion of the microstrip 60*a* is formed by the signal conductor 63*a* (labeled "S" in FIG. 6*a*) and the ground conductor 62*a* (labeled "G" in FIG. 6*a*). The impedance of the transmission line changes at the point where the microstrip and the waveguide 68*a* are joined together. High impedance mismatches cause an undesired reflection of the signal back to its incoming direction in the above-mentioned interface. This reflection problem can be diminished by making at the joint a special structure, in which the impedance level of the transmission line is gradually changed. In the example of FIG. 6*a*, this matching of the impedances has been implemented by a so-called quarter-wave transformer 67*a* It consists of steplike changes of the waveguide geometry of the length of $\lambda/4$ in the direction of the z-axis in the drawing. In FIG. 6*a*, it is accomplished by means of conductive plane surfaces 66*a*, which are connected to each other in the direction of the y-axis by vias 64*a* made of conductive material. In the direction of the x-axis, these planes 66*a* reach across the whole core part of the waveguide. The second plane 65*a* forms the lower surface of the waveguide. The electric properties of the ceramic material used in the structure are similar in all parts of the circuit structure in the example of the drawing.

Figure 6B:
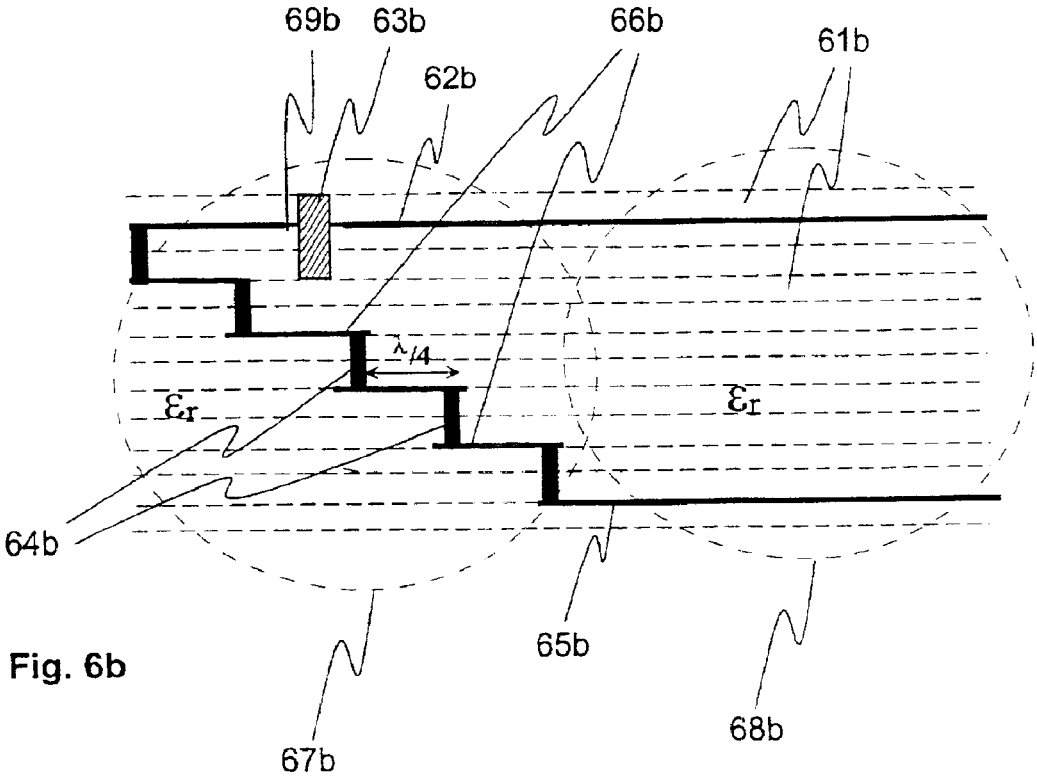
FIG. 6*b* shows an yz-plane presentation of fitting the feeding point of a waveguide according to the invention to a waveguide.

FIG. 6*b* shows an example of another way of joining a waveguide according to the invention to another electric circuit. The figure shows a section in the yz plane of the point where the transmission lines are connected. The circuit structure of the component has been implemented by joining together several layers of ceramic plates 61*b*. The exciting signal is brought to the waveguide by means of a cylindrical probe 63*b*. In the example of the drawing, the probe comes to the waveguide 68*b* through the first plane 62*b*, which forms the upper surface of the waveguide, and a hole 69*b* made in the plane. Thus the probe 63*b* does not have a galvanic connection to the conductive first plane 62*b*. The probe 63*b* itself may reach through several ceramic circuit structures in the direction of the y-axis of the drawing, when required. The impedance mismatch created at the feeding point of the signal is reduced by a quarter-wave ($\lambda/4$) transformer 67*b* of the kind described in connection with FIG. 6*a*. The quarter-wave ($\lambda/4$) transformer 67*b* consists of conductive plane surfaces 66*b*, which are connected to each other in the direction of the y-axis of the drawing by vias 64*b* made of conductive material. In the direction of the x-axis of the drawing, these planes 66*b* reach across the whole core part of the waveguide. The second plane 65*b* forms the lower surface of the waveguide. The electric properties of the ceramic material used in the structure are in similar in all parts of the circuit properties of the ceramic material used in the structure are similar in all parts of the circuit structure in the example of the drawing.

Calculatory simulations have been performed on the embodiments of the waveguides according to the invention. The simulations have been performed on both embodiments according to the invention with the same structural dimensions, whereby the measure a of the core part of the waveguide has been 5 mm, measure b 2 mm, $\epsilon_r$ of the ceramic material 5.9 and the measure L in the direction of the x-axis of the air-filled cavities that are part of the waveguide structure 2.5 mm. A mode of operation according to $TE_{10}$ has been used in the simulation, and the frequency used has been 18 GHz. As a result of the simulation, the first embodiment according to the invention had an attenuation of 1.7 dB/cm. With the same structural dimensions a and b and the same frequency 18 GHz, the waveguide structure according to the second embodiment of the invention had an attenuation value of 0.7 dB/cm.

Some preferred embodiments of the invention have been described above. However, the invention is not limited to the solutions described above. The inventive idea can be applied in many different ways within the scope defined by the attached claims.

Thus, while there have been shown and described and pointed out fundamental novel features of the present invention as applied to preferred embodiments thereof, it will be understood that various omissions and substitutions and changes in the form and details of the devices described and illustrated, and in their operation, and of the methods described may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for manufacturing a waveguide in a circuit structure using a multilayer ceramic technique, wherein said circuit structure is assembled of separate layers of ceramic, said ceramic having a permittivity $\epsilon_r$ which is higher than the corresponding value of air, and wherein, in said multilayer ceramic technique, layers, cavities, and holes are made in the ceramic layers, said method comprising the steps of:

forming two air-filled channels in said layers of ceramic extending the length of the waveguide, wherein a core of the waveguide is defined between said two air-filled channels;

forming by silk screen printing essentially parallel first and second planes of conductive material above and below the core of the waveguide, wherein said first and second conductive planes define a top and a bottom of the core of the waveguide, and wherein said first and second conductive planes do not extend past said two air-filled channels; and completing the circuit structure including the waveguide by exposing the circuit structure to a heat treatment;

wherein the multilayer ceramic technique is one of High Temperature Cofired Ceramics (HTCC) and Low Temperature Cofired Ceramics (LTCC).

2. A method for manufacturing a waveguide in a circuit structure using a multilayer ceramic technique, wherein said circuit structure is assembled of separate layers of ceramic, said ceramic having a permittivity $\epsilon_r$ which is higher than the corresponding value of air, and wherein, in said multilayer ceramic technique, layers, cavities, and holes are made in the ceramic layers, said method comprising the steps of:

forming two air-filled channels in said layers of ceramic extending the length of the waveguide, wherein a core of the waveguide is defined between said two air-filled channels and a width of each of the two air-filled channels is substantially one-fourth of a wavelength of a cutoff frequency of the waveguide; and forming by silk screen printing essentially parallel first and second planes of conductive material above and below the core of the waveguide, wherein said first and second conductive planes define a top and a bottom of the core of the waveguide, and wherein said first and second conductive planes do not extend past said two air-filled channels; and completing the circuit structure including the waveguide by exposing the circuit structure to a heat treatment.

3. A waveguide manufactured using a multilayer ceramic technique comprising:

a waveguide core defined by:

two air-filled channels extending the length of the waveguide;

a bottom surface of conductive material under the waveguide core; and a top surface of conductive material on the waveguide core;

wherein said top and bottom surfaces are substantially parallel planes;

wherein said top and bottom surfaces do not extend past said two air-filled channels; and two remaining waveguide portions defined outside said two air-filled channels;

wherein the waveguide core and the two remaining portions comprise ceramic material having the same permittivity, and wherein said permittivity is greater than the permittivity of air.

4. The waveguide according to claim 3, wherein said waveguide core further comprises:

at least one row of vias filled with conductive material and positioned close to at least one of the air-filled channels, whereby said vias galvanically connect said top and bottom surfaces.

5. The waveguide according to claim 3, wherein a hole in disposed in the top surface of conductive material to thereby excite an electromagnetic field intended to propagate in the waveguide core.

6. The waveguide according to claim 3, wherein a hole is disposed in the top surface of conductive material, and wherein said hole is fitted with a probe leading to the waveguide core to thereby excite an electromagnetic field intended to propagate in the waveguide.

7. The waveguide according to claim 3, wherein a hole is disposed in the top surface of conductive material, and wherein said hole is fitted with a coupling loop leading to the waveguide core to thereby excite an electromagnetic field intended to propagate in the waveguide.

8. The waveguide according to claim 3, wherein an interface between the waveguide core and air in the two air-filled channels defines a discontinuity of the characteristic impedance of the waveguide core.

9. The waveguide according to claim 3, wherein a ceramic structure including the waveguide is comprised substantially of the same ceramic material.

10. The waveguide according to claim 3, wherein the substantially parallel top and bottom surfaces on the waveguide core either substantially cover the waveguide core or (ii) are partly gridded.

11. The waveguide according to claim 3, wherein the multilayer ceramic technique is one of High Temperature Cofired Ceramic (HTCC) and Low Temperature Cofired Ceramics (LTCC).

12. The waveguide according to claim 3, wherein a width of each of the two air-filled channels is substantially one-fourth of a wavelength of a cutoff frequency of the waveguide.

13. The waveguide according to claim 3, wherein a waveform that can propagate in the direction of the length of the waveguide is one of a transverse-electric and transverse-magnetic waveform.

14. A method for manufacturing a waveguide in a circuit structure using a multilayer ceramic technique, wherein said circuit structure is assembled of separate layers of ceramic, said ceramic having a permittivity $\epsilon_r$ which is higher than the corresponding value of air, and wherein, in said multilayer ceramic technique, layers, cavities, and holes are made in the ceramic layers, said method comprising the steps of:

forming two air-filled channels in said layers of ceramic extending the length of the waveguide, wherein a core of the waveguide is defined between said two air-filled channels;

forming by silk screen printing essentially parallel first and second planes of conductive material above and below the core of the waveguide, wherein said first and second conductive planes define a top and a bottom of the core of the waveguide, and wherein said first and second conductive planes are defined between said two air-filled channels;

forming a first row of vias in the core of the waveguide, wherein said first row of vias is positioned close to a first air-filled channel of the two air-filled channels;

forming a second row of vias in the core of the waveguide, wherein said second row of vias is positioned close to a second air-filled channel of the two air-filled channels;

forming a third row of vias in the core of the waveguide; and completing the circuit structure including the waveguide by exposing the circuit structure to a heat treatment;

wherein each via is filled with conductive material whereby first and second planes of conductive material are galvanically connected.

15. A method for manufacturing a waveguide in a circuit structure using a multilayer ceramic technique, wherein said circuit structure is assembled of separate layers of ceramic, said ceramic having a permittivity $\epsilon_r$ which is higher than the corresponding value of air, and wherein, in said multilayer ceramic technique, layers, cavities, and holes are made in the ceramic layers, said method comprising the steps of:

forming two air-filled channels in said layers of ceramic extending the length of the waveguide, wherein a core of the waveguide is defined between said two air-filled channels;

forming by silk screen printing essentially parallel first and second planes of conductive material above and below the core of the waveguide, wherein said first and second conductive planes define a top and a bottom of the core of the waveguide, and wherein said first and second conductive planes are defined between said two air-filled channels; and forming a quarter-wave transformer at an end of the waveguide core where a signal is fed into the waveguide core; and completing the circuit structure including the waveguide by exposing the circuit structure to a heat treatment.

16. A method for manufacturing a waveguide in a circuit structure using a multilayer ceramic technique, wherein said circuit structure is assembled of separate layers of ceramic, said ceramic having a permittivity $\epsilon_r$ which is higher than the corresponding value of air, and wherein, in said multilayer ceramic technique, layers, cavities, and holes are made in the ceramic layers, said method comprising the steps of:

forming two air-filled channels in said layers of ceramic extending the length of the waveguide, wherein a core of the wavelength is defined between the two air-filled channels and two remaining portions of ceramic material are defined outside the two air-filled channels;

forming by silk screen printing essentially parallel first and second planes of conductive material above and below the core of the waveguide, wherein said first and second conductive planes define a top and a bottom of the core of the waveguide, and wherein said first and second conductive planes are defined between said two air-filled channels;

forming at least one row of vias in one of the two remaining portions of ceramic material; and completing the circuit structure including the wavelength by exposing the circuit structure to a heat treatment.

17. A method for manufacturing a waveguide using a multilayer ceramic manufacturing technique, comprising the steps of:

forming two air-filled channels extending the length of the waveguide, whereby a waveguide core is defined between said two air-filled channels and two remaining waveguide portions are defined outside said two air-filled channels, wherein the waveguide core and the two remaining waveguide portions comprise ceramic material having the same permittivity, and wherein said same permittivity is greater than the permittivity of air;

forming a bottom surface of conductive material under the waveguide core, wherein said bottom surface does not extend over the remaining waveguide portions; and forming a top surface of conductive material on the waveguide core, wherein said top surface does not extend over the remaining waveguide portions, wherein said top and bottom surfaces are substantially parallel planes.

18. The waveguide manufacturing method according to claim 17, further comprising the steps of:

forming a first row of vias in the waveguide core, wherein said first row of vias is positioned close to a first air-filled channel of the two air-filled channels; and forming a second row of vias in the waveguide core, wherein said second row of vias is positioned close to a second air-filled channel of the two air-filled channels.

19. The waveguide manufacturing method according to claim 18, further comprising the step of:

forming a third row of vias in the core of the waveguide.

20. The waveguide manufacturing method according to claim 17, further comprising the step of:

forming a quarter-wave transformer at an end of the waveguide core where a signal is fed into the waveguide core.

21. The waveguide manufacturing method according to claim 17, further comprising the step of:

forming at least one row of vias filled with conductive material and positioned close to at least one of the air-filled channels, whereby said vias galvanically connect said top and bottom surfaces.

22. The waveguide manufacturing method according to claim 17, further comprising the step of:

disposing a hole in the top surface of conductive material by means of which an electromagnetic field can be excited to thereby propagate in the waveguide core.

23. The waveguide manufacturing method according to claim 22, further comprising the step of:

fitting a probe in said hole, wherein said probe excites the electromagnetic field.

24. The waveguide manufacturing method according to claim 22, further comprising the step of:

fitting a coupling loop in said hole leading to the waveguide core, wherein said coupling loop excites the electromagnetic field.

25. The waveguide manufacturing method according to claim 17, wherein an interface between the waveguide core and air in the two air-filled channels defines a discontinuity of the characteristics impedance of the waveguide core.

26. The waveguide manufacturing method according to claim 17, wherein a ceramic structure including the waveguide is comprised substantially of the same ceramic material.

27. The waveguide manufacturing method according to claim 17, wherein the substantially parallel planes of conductive material comprising the top and bottom surfaces on the waveguide core either (i) substantially cover the waveguide core or (ii) are partly gridded.

28. The waveguide manufacturing method according to claim 17, wherein the multilayer ceramic technique is one of High Temperature Cofired Ceramics (HTCC) and Low Temperature Cofired Ceramics (LTCC).

29. The waveguide manufacturing method according to claim 17, wherein a width of each of the two air-filled channels is substantially one-fourth of a wavelength of a cutoff frequency of the waveguide.

30. The waveguide manufacturing method according to claim 17, wherein a waveform that can propagate in the direction of the length of the waveguide is one of a transverse-electric and transverse-magnetic waveform.

31. The waveguide manufacturing method according to claim 17, further comprising the steps of:

forming at least one row of vias in the core of the waveguide, wherein said at least one row of vias is positioned close to at least one of the air-filled channels and each via in the at least one row of vias is filled with conductive material whereby said first and second planes of conductive material are galvanically connected.

* * * * *